US009677470B2

(12) United States Patent
Brown et al.

(10) Patent No.: US 9,677,470 B2
(45) Date of Patent: Jun. 13, 2017

(54) BALLISTIC COVER SYSTEM

(71) Applicants: David George Brown, Spencer, TN (US); Susan JoAnne Brown, Spencer, TN (US)

(72) Inventors: David George Brown, Spencer, TN (US); Susan JoAnne Brown, Spencer, TN (US)

( * ) Notice: Subject to any disclaimer, the term of this patent is extended or adjusted under 35 U.S.C. 154(b) by 76 days.

(21) Appl. No.: 14/808,342

(22) Filed: Jul. 24, 2015

(65) Prior Publication Data

US 2017/0022896 A1 Jan. 26, 2017

(51) Int. Cl.
*F02B 77/10* (2006.01)
*F41H 5/00* (2006.01)

(52) U.S. Cl.
CPC ..... *F02B 77/10* (2013.01); *F41H 5/00* (2013.01)

(58) Field of Classification Search
CPC ..... F02B 33/38; F02B 75/00; F02F 7/0021; F02F 7/008; F02F 7/0073; F02F 2007/0075; F02F 7/0068; F02F 2007/0078; F02F 7/0065; F02F 7/0046
USPC ..... 123/198 D, 195 C
See application file for complete search history.

(56) References Cited

U.S. PATENT DOCUMENTS 5,614,280 A * 3/1997 Hanna ..... B60R 21/00 123/198 E
5,790,959 A * 8/1998 Scherer ..... H03D 7/163 455/118
5,970,959 A * 10/1999 Stroud ..... F02B 39/16 123/559.1

* cited by examiner

*Primary Examiner* — Lindsay Low
*Assistant Examiner* — Long T Tran
(74) *Attorney, Agent, or Firm* — Dunlap Bennett & Ludwig PLLC

(57) ABSTRACT

A ballistic cover system that embodies a novel ballistic blanket and method for containing energy and fragmentation projected during a supercharged engine explosion is provided. The ballistic cover system enables the ballistic blanket to react to the engine explosion, positioning itself from a racing configuration to a ballistic configuration. A plurality of restraint straps are attached to the supercharger, keeping it along a controlled path during the explosion. Moreover, two of the restraint straps act as mounting rails that the ballistic blanket rides along when reactively moving from the racing configuration to the ballistic configuration.

10 Claims, 5 Drawing Sheets

BALLISTIC COVER SYSTEM

BACKGROUND OF THE INVENTION

The present invention relates to explosive containment systems and, more particularly, to a ballistic cover system that embodies a novel apparatus and method for containing energy and fragmentation projected during a supercharged engine explosion.

Supercharged engines, such as the Roots type supercharger, frequently explode during competition, in part because of the use of nitro-methane fuel. When supercharged race engines explode the resulting energy and projected fragmentation poses a sever risk of personal injury and mechanical damage. Currently, containment covers used to control such explosions fail to fully contain such energy and fragmentation. Current containment covers, partly because of the confined space available around a competitive supercharged race engine, are compromised in terms of their location and/or positioning when installed. And when operative, current containment covers do not respond or move properly during the impact thus allowing energy and fragmentation to circumvent containment, and so do not fully dissipate the energy. Moreover, current containment systems tend to be rigid in composition and/or attachment, making installation, removal and replacement time intensive.

As can be seen, there is a need for a ballistic cover system that embodies a novel apparatus and method for containing energy and fragmentation projected during a supercharged engine explosion, whereby the ballistic cover system enables the novel apparatus to react to the engine explosion, positioning itself from a racing configuration to a ballistic configuration.

SUMMARY OF THE INVENTION

In one aspect of the present invention, a ballistic cover system for a competitive supercharged engine includes a top plate connected to an upper portion of the supercharged engine; a plurality of side restraint straps extending from each opposing side periphery of the top plate to the competitive supercharged engine; two rear restraint straps extending from a rear periphery of the top plate to the competitive supercharged engine/Bell Housing mounted Blast Plates; a ballistic blanket forming an elongated tunnel along each of its longitudinal edges, wherein each elongated tunnel slidably receives one of the two rear restraint straps so as to be moveable there along.

In another aspect of the present invention, the ballistic cover system may also include a rear blast shield mounted on the bell-housing of the competitive supercharged engine.

In yet another aspect of the present invention, a method of containing fragmentation and energy from an explosive event of a competitive supercharged engine, includes the steps of providing a competitive supercharged engine; attaching a top plate to an upper portion of the competitive supercharged engine; extending a plurality of restraint straps from opposing side peripheries of the top plate to a lower portion of the competitive supercharged engine; extending two rear restraint straps from a rear periphery of the top plate to the competitive supercharged engine; providing a ballistic blanket forming an elongated tunnel along each of its longitudinal edges; and sliding each restraint strap through opposing elongated tunnels when extending the two restraint straps to the competitive supercharged engine.

These and other features, aspects and advantages of the present invention will become better understood with reference to the following drawings, description and claims.

DETAILED DESCRIPTION OF THE INVENTION

Figure 1:
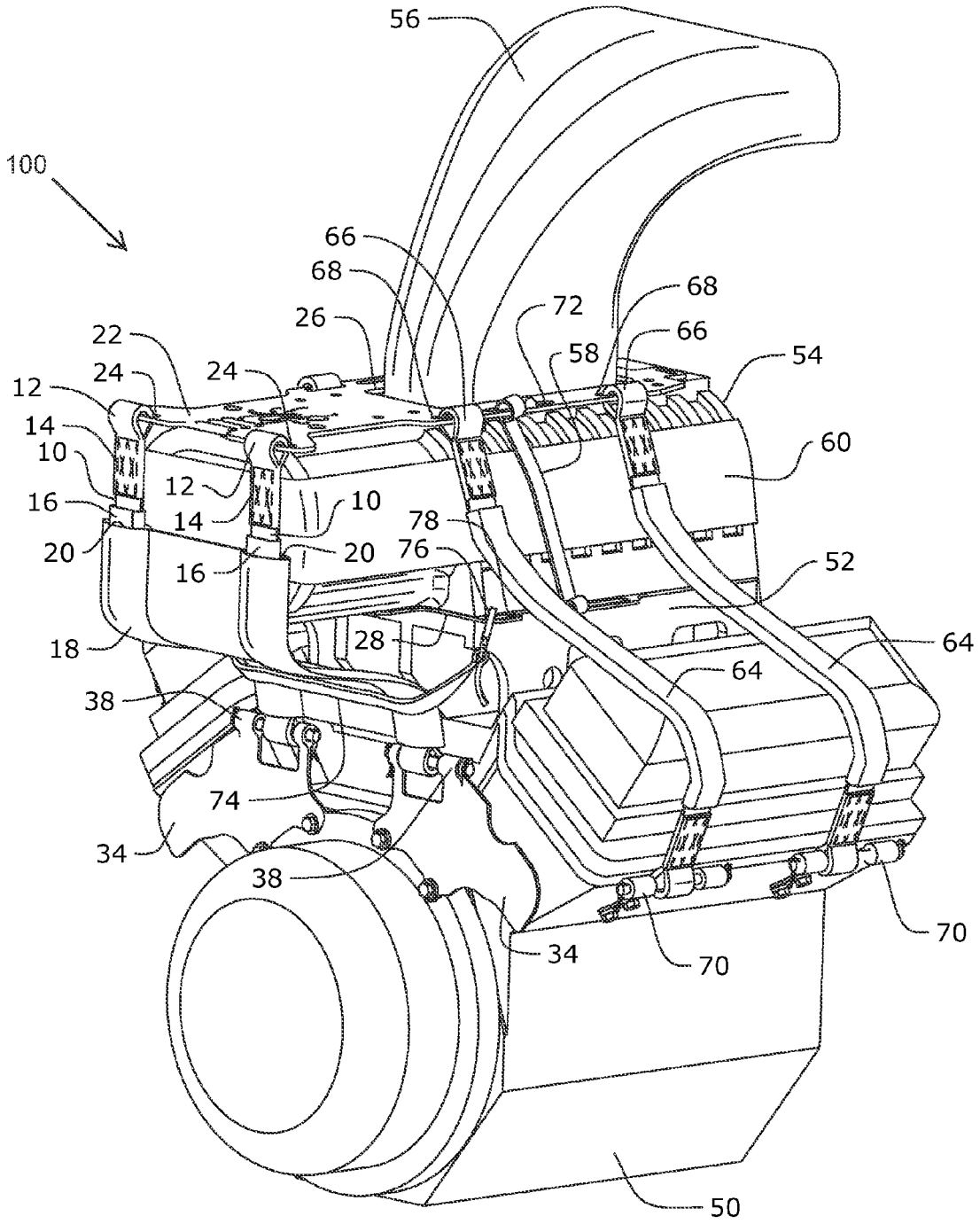
FIG. 1 is a perspective view of an exemplary embodiment of the present invention, shown in a racing configuration.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a ballistic cover system that embodies a novel ballistic blanket and method for containing energy and fragmentation projected during a supercharged engine explosion, whereby the ballistic cover system enables the ballistic blanket to react to the engine explosion, positioning itself from a racing configuration to a ballistic configuration. A plurality of restraint straps are attached to the supercharger, keeping it along a controlled path during the explosion. Moreover, two of the restraint straps act as mounting rails that the ballistic blanket rides along when reactively moving from the racing configuration to the ballistic configuration.

Referring to FIGS. 1 through 14, the present invention may include a ballistic cover system 100 that embodies a ballistic blanket 18 and method for installing it to a competitive supercharged engine so that the ballistic blanket 18 reacts to an engine explosion, positioning itself from a racing configuration to a ballistic configuration.

The ballistic cover system 100 may include the ballistic blanket 18, a top plate 22, a bottom plate 28, a plurality of blast plates 34, and a plurality of restraint straps 10, all of which are dimensioned and adapted to operatively attach to a predetermined competitive supercharged engine. The competitive supercharged engine may include an engine block 50, a manifold 52, a blower diaper 60, a supercharger 54, and an injector hat ("scoop") 56, generally arranged as illustrated in FIG. 1.

The bottom plate 28 of the ballistic cover system 100 may be disposed between the manifold 52 and the blower diaper 60, as illustrated in FIG. 1. The bottom plate 28 may be made of ballistic material with suitable energy absorption capability, such as but not limited to titanium. The bottom plate 28 may form a plurality of mass openings 32 to allow for weight reduction. The bottom plate 28 may form a plurality of bottom strap slots 30 along but inward from its periphery, wherein each bottom strap slot 30 is dimensioned and adapted to slidably receive a plate to plate strap 58 or a loop thereof. The bottom plate 28 may form retention slots 78 dimensioned and adapted to operatively engage a break-away strap 74 or a loop and/or a strap clip 76 thereof.

The top plate 22 of the ballistic cover system 100 may be coupled to an upper portion of the supercharger 54, as illustrated in FIG. 1. The top plate 22 may be made of ballistic material with suitable energy absorption capability, such as but not limited to titanium. The top plate 22 may form a scoop opening 26 to accommodate the injector hat 56 extending out of the supercharger 54. The top plate 22 may form a plurality of rear plate strap slots 24 and side plate strap slots 68 along but inward from its rear and side periphery, respectively, wherein each plate strap slot 24, 68 may be dimensioned and adapted to slidably receive a restraint strap 10 or a loop 12 thereof. The rear periphery may coincide with a rear portion of the supercharger 54, as illustrated in FIG. 1. The top plate 22 may form a plurality of top strap slots 72 along but inward from its periphery, wherein each top strap slot 72 is dimensioned and adapted to slidably receive a plate to plate strap 58 or a loop thereof.

Figure 14:
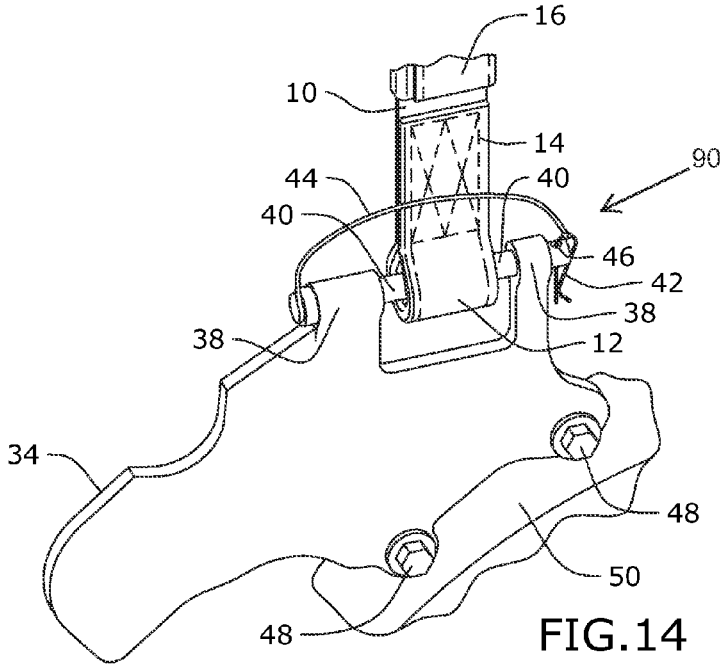
FIG. 14 is a perspective detail view of an exemplary embodiment of the present invention.

The plurality of blast plates 34 may be made of ballistic material with suitable energy absorption capability, such as but not limited to titanium. The plurality of blast plates 34 may include a plurality of fastener holes 46 adapted to receive fasteners 48 therethrough to connect each blast plate 34 to the engine block 50, bell-housing, or the like. Each blast plate 34 may form a locking mechanism 90 to secure and unsecure a restraint strap 10 or a loop 12 thereof thereto. Each locking mechanism 90 may include a pair of pin protrusions 38 forming aligned retention holes for slidably receiving a retention pin 40 therein, so that the retention pin 40 retains the loop 12 of a restraint strap 10. The locking mechanism 90 may be locked by a retention clip 42 adapted to operatively engage a clip hole 46 formed in the retention pin 40 so as to prevent the retention pin 40 from sliding out of a retention hole, as illustrated in FIG. 14. In certain embodiments, the locking mechanism 90 may provide a tether strap 44 coupling the retention clip 42 to the retention pin 40. The plurality of blast plates 34 may be connected to portions of the engine block and or Bell-housing 50 so as to cover the area behind the engine where failed head gaskets are commonly expelled. In certain embodiments, the plurality of blast plates 34 may be secured to the engine block 50 by welding.

Each restraint strap 10 may extend from a first end to a second end, each end terminating in a loop 12. Each restraint strap 10 may be made from 4088 military webbing (conforming to SFI 14.3 Specs) or another material of at least equivalent tensile strength. Each restraint strap 10 may be stitched using Kevlar or equivalent stitching 14 to provide required strength. Each restraint strap 10 may be at least partially sheathed in fire retardant wraps 16.

The ballistic blanket 18 may be a plurality of interwoven layered sheets made of ballistic fabric such as but not limited to Kevlar, Nomex and the like so as to have sufficient strength to absorb explosive fragmentation and dissipate energy resulting from supercharged engine explosions yet supple in installation and use. The ballistic blanket 18 may form a plurality of elongated tunnels 20 along its opposing longitudinal sides. Each tunnel 20 may be dimensioned and adapted to slidably receive a restraint strap 10 with fire retardant straps 16 therethrough.

A method of using the present invention may include the following. The ballistic cover system 100 disclosed above may be provided. After attaching the bottom plate 28, a user may bolt or otherwise rigidly connect the top plate 22 to the upper portion of the supercharger 54. The user may then interconnect the top and bottom plates 22, 28 with a sufficiently strong plate to plate strap 58 through their respective strap slots 72, 30.

Figure 13:
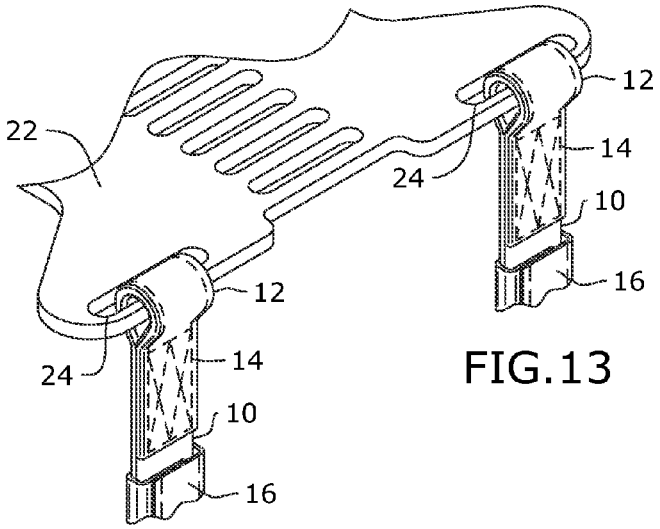
FIG. 13 is a perspective detail view of an exemplary embodiment of the present invention.

Then the user measures the competitive supercharged engine to determine the length of the restraint straps 10 to be connected from the side plate strap slots 68 of the top plate 22, as illustrated in FIG. 13, to the competitive supercharged engine. In certain embodiments, these "side" restraint straps 10 may be suitably attached to the engine block 50 via side strap brackets 70 illustrated in FIG. 9. The length of the "rear" restraint straps 10 may then be determined and connected at each end from the rear plate strap slots 24 of the top plate 22 to the locking mechanism 90 of the blast plates 34.

Figure 2:
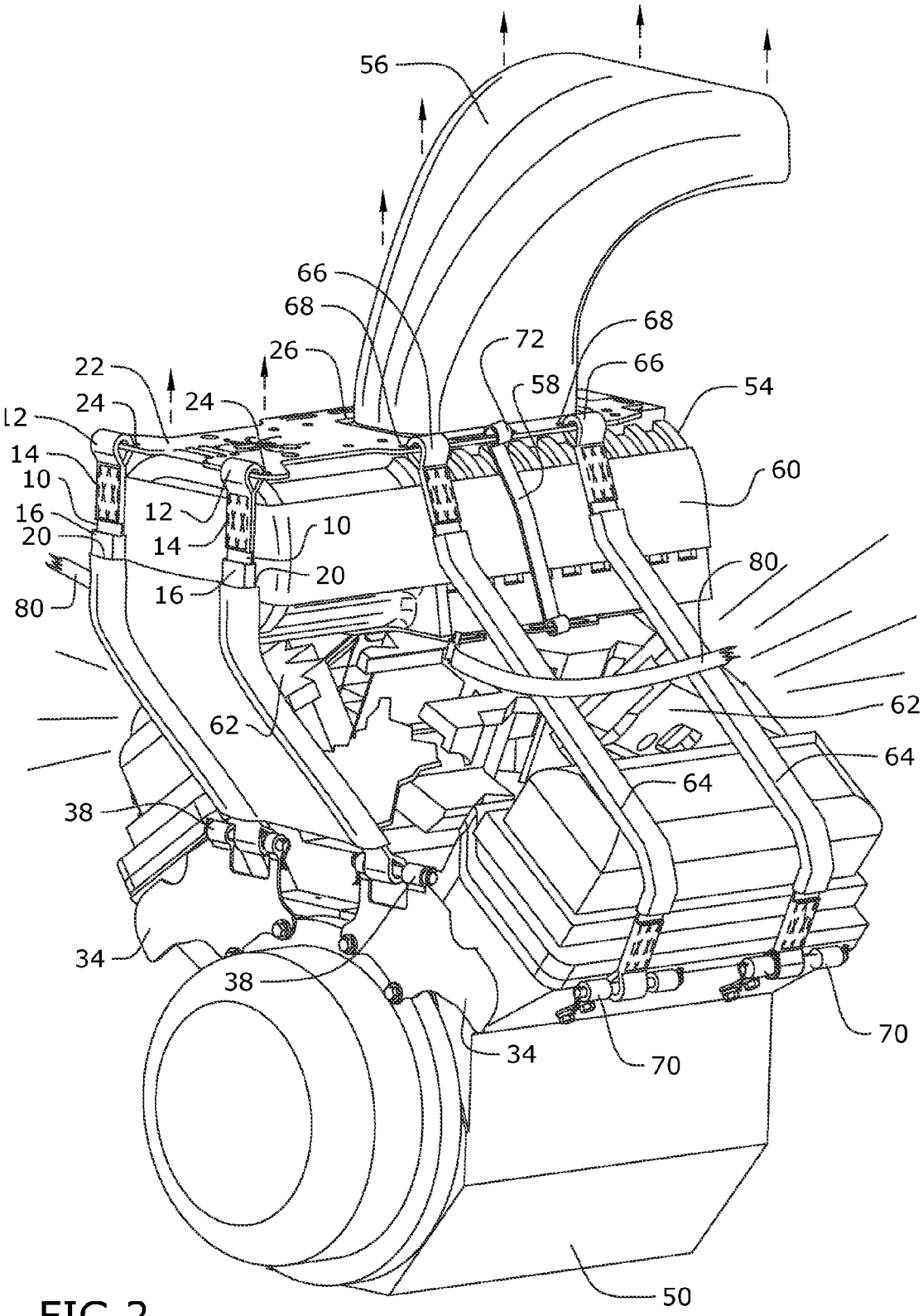
FIG. 2 is a perspective view of an exemplary embodiment of the present invention, demonstrating a ballistic configuration during an explosion event.
Figure 3:
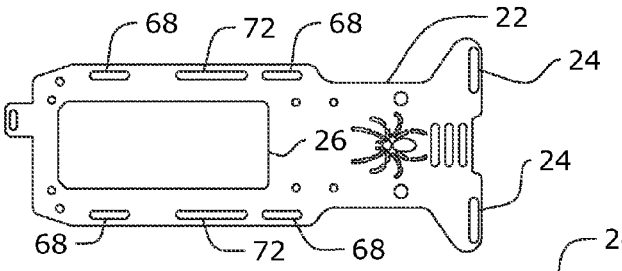
FIG. 3 is a top view of an exemplary embodiment of a top plate of the present invention.
Figure 4:
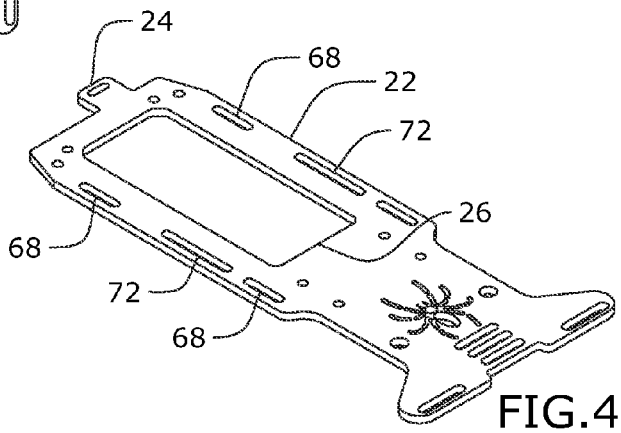
FIG. 4 is a perspective view of an exemplary embodiment the top plate of the present invention.
Figure 5:
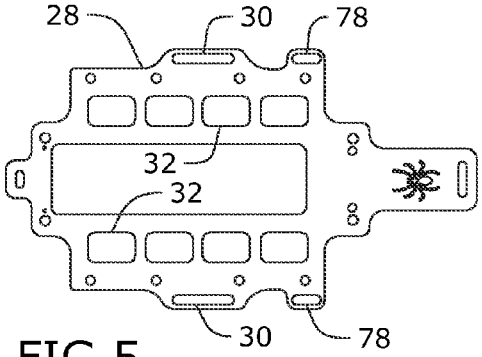
FIG. 5 is a top view of an exemplary embodiment of a bottom plate of the present invention.
Figure 6:
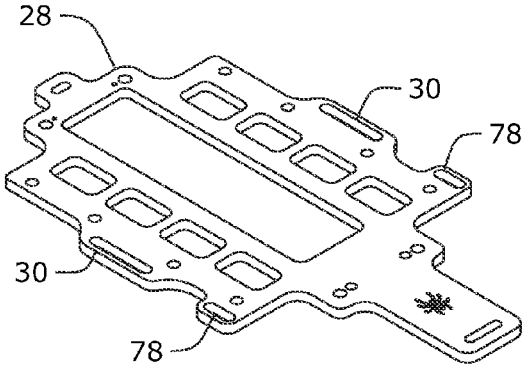
FIG. 6 is a perspective view of an exemplary embodiment of the bottom plate of the present invention.
Figure 7:
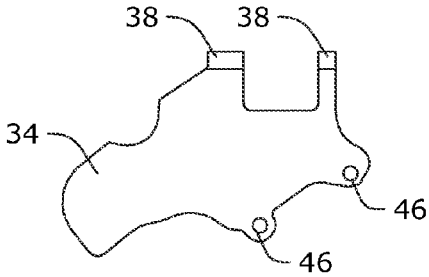
FIG. 7 is a front view of an exemplary embodiment of a blast plate of the present invention.
Figure 8:
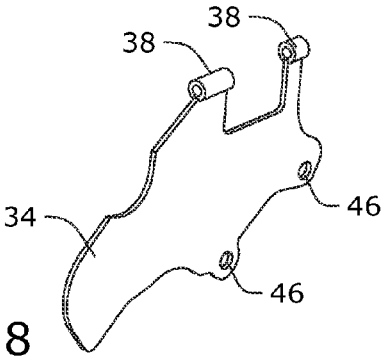
FIG. 8 is a perspective view of an exemplary embodiment of the blast plate of the present invention.
Figure 10:
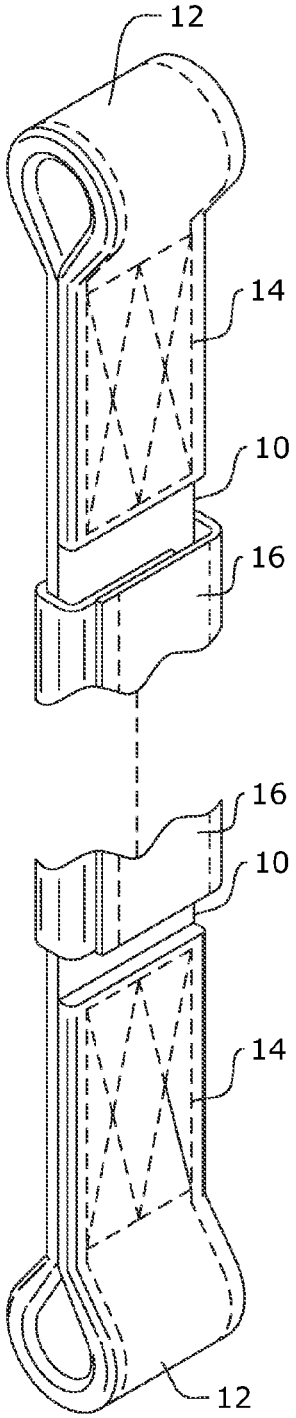
FIG. 10 is a perspective detail view of an exemplary embodiment a restraint strap of the present invention.
Figure 9:
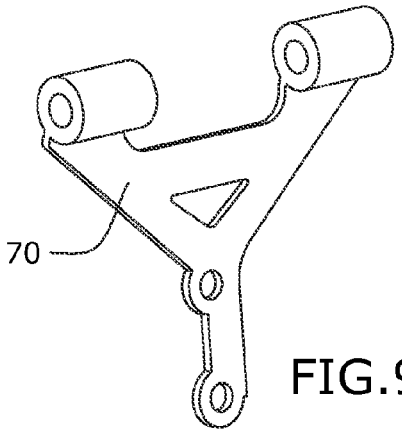
FIG. 9 is a perspective view of an exemplary embodiment of a strap bracket of the present invention.
Figure 11:
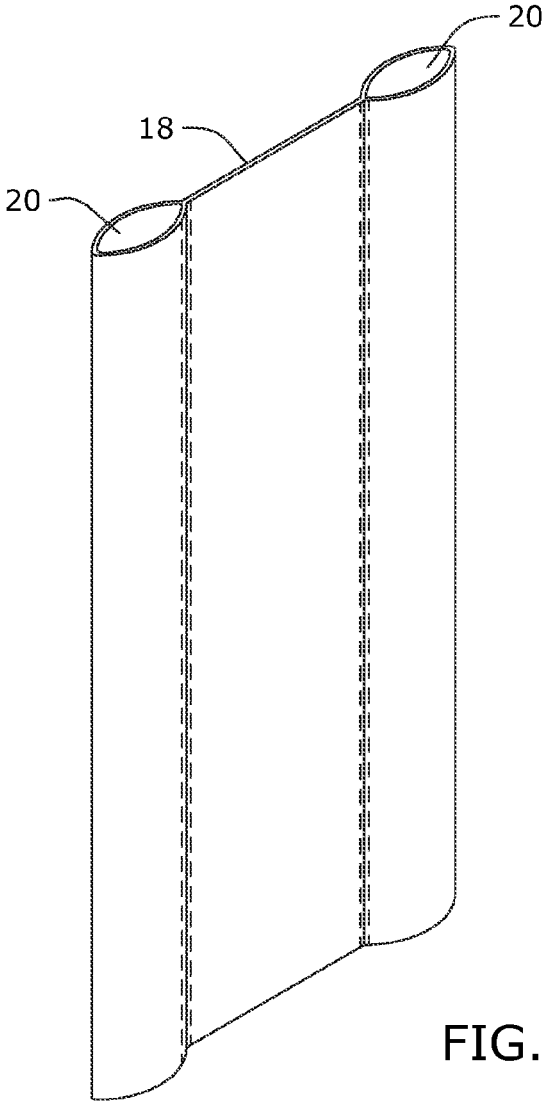
FIG. 11 is a perspective view of an exemplary embodiment of a ballistic blanket of the present invention.
Figure 12:
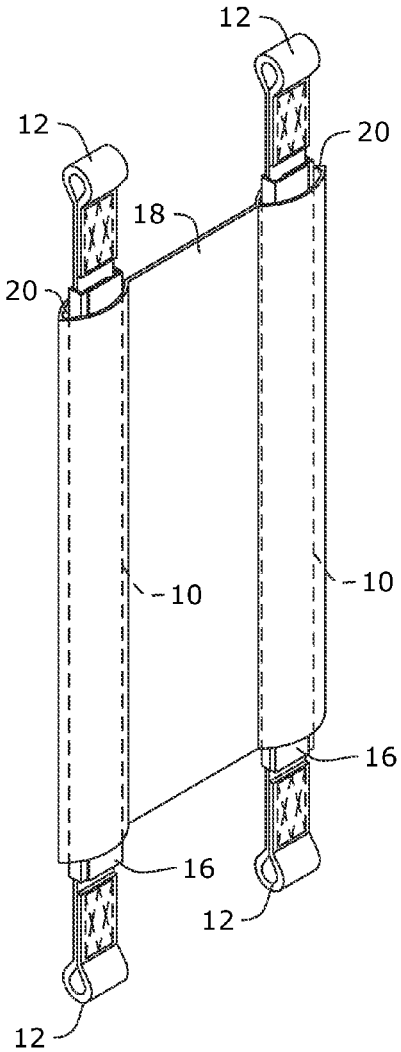
FIG. 12 is a detailed perspective view of an exemplary embodiment of the present invention.

The predetermined length of the restraint straps 10 are calculated so that when there is an engine explosive event, as illustrated in FIG. 2, the supercharger 54, which tends to accelerate generally upwardly during such event, is kept in a controlled path whereby the rear restraint straps 10 sufficiently tighten. When the rear restraint straps 10 tighten, the elongated tunnels 20 may ride along said rear restraint straps 10 so that the ballistic blanket 18 is pulled closer to a blast site. The blast site is source of a substantial portion of accelerating fragmentation caused by the explosive event, as illustrated in FIG. 2, whereby if not properly contained, the release energy/fragmentation would damage equipment, spectators and/or injure the driver.

As a result, the ballistic blanket 18 is mounted on the rear restraint straps 10 so as to be reactive to an explosive event, sliding from a racing configuration to a ballistic configuration near a predetermined blast site. Such "mounting rails" facilitates easy removal and replacement of the apparatus that contains the explosive debris, as opposed to a rigid apparatus that must be rigidly fastened to the engine.

In the racing configuration, the ballistic blanket 18 can be snugly tighten to a rear portion of the supercharger by the break-away strap 74 extending from opposing retention slots 78 of the bottom plate 28. The break-away strap 74 may be adapted to be broken 80 during an explosive event so as to enable the repositioning of the ballistic blanket 18 to the ballistic configuration, as illustrated in FIG. 2.

The ballistic cover system 100 can be used for numerous applications in the competitive racing industry, wherever there is a likelihood of an explosive event involving an engine, including, but not limited to auto, boat, tractors and airplane racing.

It should be understood, of course, that the foregoing relates to exemplary embodiments of the invention and that modifications may be made without departing from the spirit and scope of the invention as set forth in the following claims.

What is claimed is:

1. A ballistic cover system for a competitive supercharged engine, comprising:

a top plate connected to an upper portion of the supercharged engine;

a plurality of side restraint straps extending from each opposing side periphery of the top plate to the competitive supercharged engine;

two rear restraint straps extending from a rear periphery of the top plate to the competitive supercharged engine; and a ballistic blanket forming an elongated sleeve along each of its longitudinal edges, the ballistic blanket mounted on the two rear restraint straps wherein each elongated sleeve receives one of the two rear restraint straps strap.

2. The ballistic cover system of claim 1, wherein a predetermined length of each rear restraint strap enables the ballistic blanket mounted to the two ear restraint straps to move from a folded condition in a racing configuration to a tightened condition in a ballistic condition during an explosive event.

3. The ballistic cover system of claim 1, further comprising a plurality of side and two rear plate strap slots formed in the top plate along and inward from the side and rear peripheries, respectively, of the top plate, each plate strap slots adapted to connect to an end of each restraint strap.

4. The ballistic cover system of claim 1, further comprising:

a bottom plate connected to a lower portion of the supercharged engine; and at least one plate to plate strap interconnecting the top and bottom plates.

5. The ballistic cover system of claim 1, further comprising a blast plate interconnecting the supercharged engine to each rear restraint strap, wherein each blast plate is disposed along the supercharged engine near where failed head gaskets are commonly explosively expelled.

6. The ballistic cover system of claim 1, further comprising a strap bracket interconnecting the supercharged engine to each side restraint strap.

7. The ballistic cover system of claim 1, wherein each rear restraint strap extends through both ends of its respective elongated sleeve as said rear restraint strap extends from the rear periphery of the top plate to the competitive supercharged engine.

8. A method of containing fragmentation and energy from an explosive event of a competitive supercharged engine, comprising the steps of:

providing a competitive supercharged engine;

attaching a top plate to an upper portion of the competitive supercharged engine;

extending a plurality of restraint straps from opposing side peripheries of the top plate to a lower portion of the competitive supercharged engine;

extending two rear restraint straps from a rear periphery of the top plate to the competitive supercharged engine;

providing a ballistic blanket forming an elongated sleeve along each of its longitudinal edges; and sliding each restraint strap through opposing elongated sleeve when extending the two restraint straps to the competitive supercharged engine.

9. The method of claim 8, further comprising the step of measuring the competitive supercharged engine to determine a length for each rear restraint strap so that the ballistic blanket mounted thereto are movable from a folded condition in a racing configuration to a tightened condition in a ballistic condition during the explosive event.

10. The method of claim 8, further comprising the step attaching a blast plate interconnecting the supercharged engine to each rear restraint strap, wherein each blast plate is disposed along the supercharged engine near where failed head gaskets are commonly explosively expelled.

* * * * *